US006939001B2

(12) United States Patent
Buibas

(10) Patent No.: US 6,939,001 B2
(45) Date of Patent: Sep. 6, 2005

(54) MECHANISM FOR PASSING RIGID MEDIUM UNDER IMAGE-FORMING MECHANISM

(75) Inventor: Marius Buibas, Chula Vista, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/285,154

(22) Filed: Oct. 31, 2002

(65) Prior Publication Data

US 2004/0085424 A1 May 6, 2004

(51) Int. Cl.[7] ..... B41J 2/01; B41J 2/165

(52) U.S. Cl. ..... 347/104; 374/35; 374/36

(58) Field of Search ..... 347/104, 35, 36, 347/106, 14, 16; 101/41–44; 400/635; 271/275; 399/303, 312, 313; 346/134, 136

(56) References Cited

U.S. PATENT DOCUMENTS

| | | | | |
|---|---|---|---|---|
| 5,715,934 A | * | 2/1998 | Tobol et al. | 206/232 |
| 5,740,511 A | | 4/1998 | Todome | 399/303 |
| 6,129,013 A | | 10/2000 | Takasawa et al. | 101/114 |
| 6,168,259 B1 | * | 1/2001 | Capurso | 347/36 |
| 6,192,210 B1 | * | 2/2001 | Munenori et al. | 399/165 |
| 6,298,586 B1 | | 10/2001 | Todome | 39/303 |
| 6,309,064 B1 | * | 10/2001 | Tanno et al. | 347/104 |
| 6,332,680 B1 | * | 12/2001 | Ozawa | 347/104 |

FOREIGN PATENT DOCUMENTS

| | | | |
|---|---|---|---|
| DE | 69801185 T2 | | 11/2001 |
| EP | 0887196 A2 | | 12/1998 |
| JP | 58011444 | * | 1/1983 |
| JP | 110348313 | | 12/1999 |
| JP | 2001347651 | | 12/2001 |
| JP | 2001347692 | | 12/2001 |

OTHER PUBLICATIONS

Search Report for GB Application No. 0325177.4

* cited by examiner

*Primary Examiner*—Michael S. Brooke

(57) ABSTRACT

An embodiment of the invention is disclosed that relates to a mechanism for passing a rigid medium under an image-forming mechanism. The mechanism includes a conveyor belt and a number of rollers. The rigid medium travels on the conveyor belt under the image-forming mechanism, for image formation on the rigid medium. The rollers move the conveyor belt.

48 Claims, 3 Drawing Sheets

MECHANISM FOR PASSING RIGID MEDIUM UNDER IMAGE-FORMING MECHANISM

BACKGROUND

Image-forming devices, such as inkjet, laser, and other types of printers, are perhaps most commonly used to print on non-rigid, or flexible, media, such as paper. Business users may employ printers to print memos, presentations, copies of email, and so on. Home users may similarly employ printers to print photographs, homework reports, labels, copies of email, and so on. However, more specialized image-forming devices usually are used to print on rigid media.

Such rigid media may include optical discs, such as compact discs (CD's) and digital versatile discs (DVD's), and plastic, such as identification cards, and so on. Although the actual image-forming mechanism may be the same for outputting on rigid media as it is for outputting on non-rigid media, rigid media introduce a perhaps unique set of challenges for image-forming devices. For instance, because a rigid medium by definition cannot be easily bent as it passes through an image-forming device, different media-handling mechanisms usually must be used than those used for flexible media.

Whereas image-forming devices generally can achieve rather fast throughput for non-rigid media, owing to the ability of the non-rigid media to be bent as it winds through the media-handling mechanisms of such devices, comparable throughput for rigid media is more difficult to accomplish. This can be disadvantageous in situations where fast throughput is desired, however.

SUMMARY OF THE INVENTION

An embodiment of the invention relates to a mechanism for passing a rigid medium under an image-forming mechanism. The mechanism includes a conveyor belt and a number of rollers. The rigid medium travels on the conveyor belt under the image-forming mechanism, for image formation on the rigid medium. The rollers move the conveyor belt.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE INVENTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
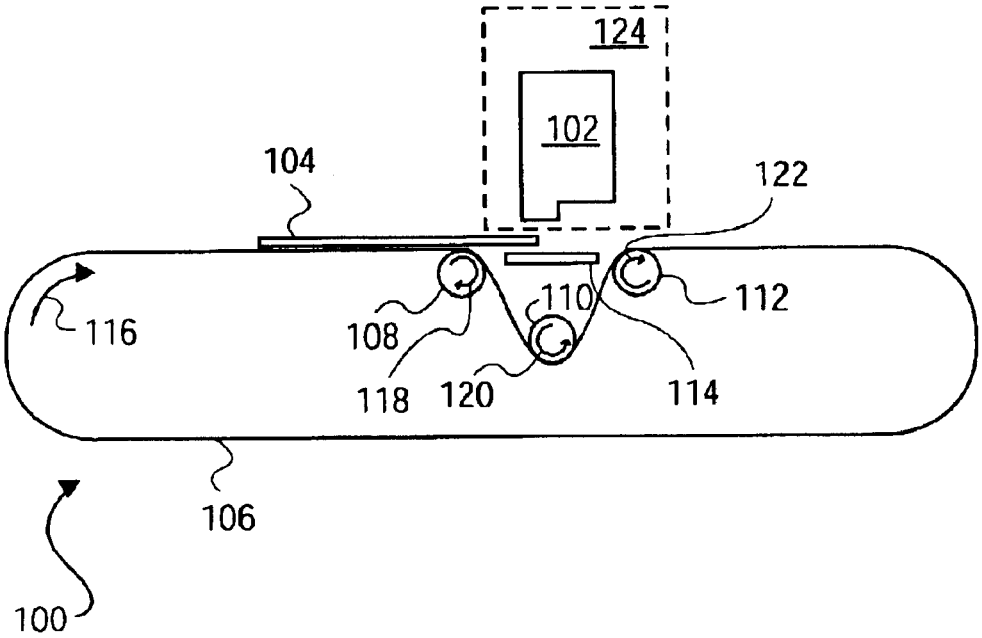
FIG. 1 is a diagram of the side profile of a mechanism for passing a rigid medium under an image-forming mechanism, according to an embodiment of the invention.

FIG. 1 shows a mechanism 100 for passing a rigid medium 104 under an image-forming mechanism 124 that includes an image-forming head 102, according to an embodiment of the invention. The rigid medium 104 may be an optical disc, such as a compact disc (CD) or a digital versatile disc (DVD), plastic, such as an identification card, or another type of rigid media. The rigid medium 104 has the attribute of not being able to be bent as easily as non-rigid, flexible media, such as paper. For instance, an optical disc or plastic is not very flexible, and if bent too far, can break.

The image-forming mechanism 124 may be a printer or another type of image-forming mechanism. The printer may be an inkjet printer, a laser printer, or another type of printer. The image-forming head 102 is generally the component of the image-forming mechanism 124 that actually forms an image on the rigid medium 104. In the context of an inkjet printer, the image-forming head 102 may be an inkjet printhead, for instance, that outputs ink onto the medium 104. In the context of a laser printer, the image-forming head 102 may include the drum under which the medium 104 travels for transfer of toner to the medium 104.

The mechanism 100 in the embodiment of FIG. 1 specifically includes a conveyor belt 106, rollers 108, 110, and 112, and an image-forming substance-absorbing mechanism 114. The conveyor belt 106 is generally any type of material onto which the rigid medium 104 can be moved, resulting from movement of the conveyor belt 106. In this respect, the belt may be a track, a chain, a band, or another type of belt. The conveyor belt 106 moves in a loop in the direction indicated by the arrow 116.

The conveyor belt 106 acts or serves as a bottom contact for the rigid medium 104 as it travels under the image-forming mechanism 124. Preferably, the rigid medium 104 does not have any top contact with any other component of the mechanism 100. Thus, it can be said that the mechanism 100 is preferably top contactless. Furthermore, preferably the conveyor belt 106 travels only in the direction of the arrow 116, or in the opposite direction of the arrow 116, and not, for instance, into and out of the plane of FIG. 2. That is, the conveyor belt 106 preferably moves the rigid medium 104 under the image-forming mechanism 124 from left to right and/or right to left.

The rollers 108, 110, and 112 facilitate movement of the conveyor belt 106. The roller 108 may specifically be a drive roller, rotating in the direction indicated by the arrow 118. A drive roller is the roller that is connected to a motor or other movement mechanism, and which is actually forced to rotate, providing force to cause movement of the conveyor belt 106. The roller 110 may specifically be a tension roller, rotating in the direction indicated by the arrow 120. A tension roller is the roller that provides tension to the belt 106, so that it does not, for example, sag under the weight of the rigid medium 104. The roller 112 may specifically by a follower roller, rotating in the direction indicated by the arrow 122. A follower roller is the roller that serves to align the medium 104 back onto the belt 106 after it passes under the image-forming mechanism 124. Furthermore, there may be more or less rollers than the rollers 108, 110, and 112 in alternative embodiments of the invention.

The image-forming substance-absorbing mechanism 114 absorbs any overage of the image-forming substance output by the image-forming head 102 of the image-forming mechanism 124. For instance, where the image-forming head 102 outputs ink, the substance-absorbing mechanism 114 may be an absorbent foam pad to absorb any overage of the ink that does not output onto the rigid medium 104. Where the image-forming head 102 applies toner, the substance-absorbing mechanism 114 may be a different type of substance-absorbing mechanism. The rigid medium 104 thus travels between the substance-absorbing mechanism 114 and the image-forming head 102 of the image-forming mechanism 124.

The rollers 108, 110, and 112 are thus positioned so as to guide the conveyor belt 106 away from the image-forming substance-absorbing mechanism 114 as the rigid medium 104 passes under the image-forming head 102 of the image-forming mechanism 124. Specifically, the tension roller 110, located downwards from the rollers 108 and 112, causes the belt 106 to likewise move downward after it travels over the drive roller 108. The follower roller 112 than causes the belt 106 to move upward, to the same level as it had traveled prior to moving downward.

The positioning of the rollers 108, 110, and 112 and the positioning of the image-forming substance-absorbing mechanism 114 therefore permit full-bleed image formation by the image-forming head 102 of the image-forming mechanism 124 onto the rigid medium 104, while substantially preventing substance contamination of the conveyor belt 106. Full-bleed image formation onto the medium 104 means that the medium 104 is covered edge to edge. To accomplish this, the head 102 usually must apply its substance, such as ink or toner, past the edges of the medium 104, to ensure that the medium 104 is covered edge to edge. Such substance overage is absorbed by the substance-absorbing mechanism 114 so that it does not contaminate the belt 106. The movement of the belt 106 away from and under the substance-absorbing mechanism 114 also serves to prevent contamination of the belt 106. Contamination of the belt 106 is the incidental and unintended output of the image-forming substance onto the belt 106.

Figure 2:
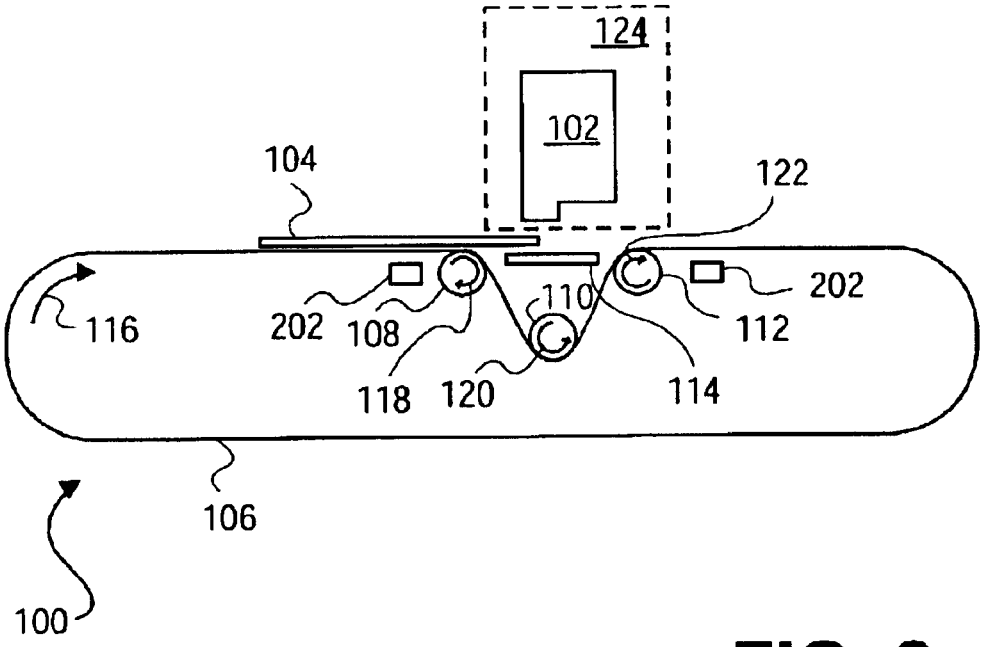
FIG. 2 is a diagram of the side profile of a mechanism for passing a rigid medium under an image-forming mechanism, according to another embodiment of the invention.

FIG. 2 shows the mechanism 100 for passing the rigid medium 104 under the image-forming head 102 of the image-forming mechanism 124, according to another embodiment of the invention. The mechanism 100 of the embodiment of FIG. 2 is substantially the same as that of the embodiment of FIG. 1. Like-numbered components of the mechanism 100 of the embodiments of FIGS. 1 and 2 operate substantially identically, and therefore description thereof in the context of FIG. 2 is omitted to avoid duplication.

The difference between the mechanism 100 of the embodiment of FIG. 2, as compared to that of the embodiment of FIG. 1, is the presence of a pull-down mechanism 202. The pull-down mechanism 202 assists maintenance of the positioning of the rigid medium 104 as it travels between the image-forming head 102 of the image-forming mechanism 124 and the image-forming substance-absorbing mechanism 114. That is, the pull-down mechanism 202 aids maintenance of the positioning of the rigid medium 104 as it leaves the conveyor belt 106 after passing over the roller 108, and as it travels back over the belt 106 at the roller 112. Whereas the pull-down mechanism 202 is depicted in FIG. 2 as being located both before and after the substance-absorbing mechanism 114, in alternative embodiments it may be located only before or after the mechanism 114. The pull-down mechanism 202 increases friction between the rigid medium 104 and the conveyor belt 106.

The pull-down mechanism 202 may in one embodiment by a suction or a vacuum mechanism that pulls down the rigid medium 104 via suction or vacuum effect as it travels under the image-forming head 102 of the image-forming mechanism 124. In another embodiment, the pull-down mechanism 202 may be a statically charged mechanism, which pulls down the medium 104 by charged attraction as the medium travels under the head 102 of the image-forming mechanism 124. By assisting maintenance of the positioning of the medium 104 as it travels under the image-forming mechanism 104, the pull-down mechanism 202 can enable the medium 104 to move more quickly past the mechanism 104, improving throughput.

Figure 3:
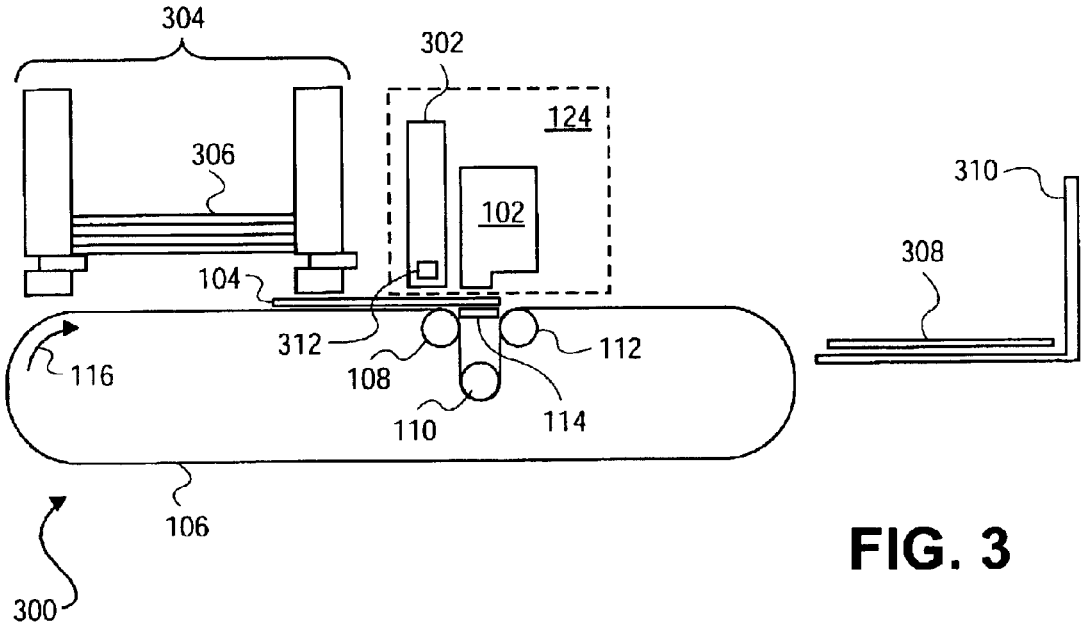
FIG. 3 is a diagram of the side profile of an image-forming device that includes a mechanism for passing a rigid medium under an image-forming mechanism of the device, according to an embodiment of the invention.
Figure 4:
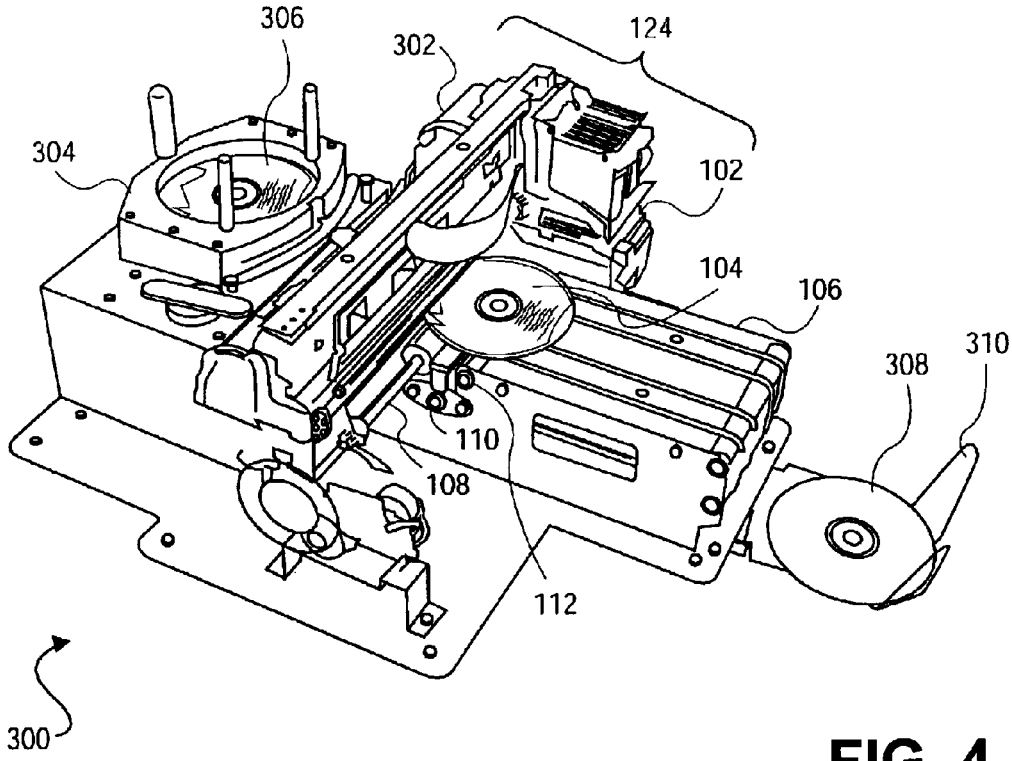
FIG. 4 is a diagram of the perspective view of the image-forming device of FIG. 3, according to an embodiment of the invention.

FIGS. 3 and 4 show an image-forming device 300 that employs the components of the mechanism 100 of FIG. 1, according to an embodiment of the invention. FIG. 3 is specifically the side profile of the image-forming device 300, whereas FIG. 4 is specifically a perspective view of the device 300. Like-numbered components of the embodiments of FIGS. 1, 3, and 4 operate substantially identically, and therefore description thereof in the context of FIGS. 3 and 4 is substantially omitted to avoid duplication. Furthermore, the pull-down mechanism 202 of FIG. 2 may be integrated into the image-forming device 300 of FIGS. 3 and 4, although it is not depicted in FIGS. 3 and 4.

The image-forming device 300 is specifically for image formation on rigid media that are optical discs, such as CD's and DVD's. Furthermore, the image-forming mechanism 124 of the image-forming device 300 is specifically depicted as an inkjet printing mechanism. However, embodiments of the invention are not limited to an image-forming device for image formation on optical discs. Similarly, embodiments of the invention are not limited to an image-forming device that includes an image-forming mechanism that is an inkjet printing mechanism. The image-forming mechanism 124 may in one embodiment be that of an inkjet printer that was originally built for flexible media such as paper.

The image-forming mechanism 124 of the image-forming device 300 includes an image-forming head 102 and an additional image-forming sub-mechanism 302. The image-forming head 102 is an inkjet printhead that, as specifically depicted in FIG. 4, is able to travel back and forth over the rigid medium 104. The additional image-forming sub-mechanism 302 may include the electronics and other components of the image-forming mechanism 124. For instance, the sub-mechanism 302 may include an out-of-media sensor 312, as specifically depicted in FIG. 3, that detects when an additional rigid medium does not follow the rigid medium 104 under the image-forming head 102 as expected. The sensor 312 may in one embodiment be the same sensor that is used by an inkjet printer to detect when flexible media, such as paper, is no longer being supplied to the image-forming head 102. Furthermore, the sensor 312 may be used to detect the top of form of the medium within the print zone, and also mis-feeds, where the medium appears longer than expected.

The image-forming device 300 includes a feeding mechanism 304 and a collecting mechanism 310. The feeding mechanism 304 is receptive of a supply of rigid media 306 that are individually ejected for placement on the conveyor belt 106. That is, the feeding mechanism 304 feeds the rigid media 306 onto the conveyor belt 106. Thus, the rigid medium 104 passing under the image-forming mechanism 124 was originally part of the supply of rigid media 306. The collecting mechanism 310 collects rigid media, such as the rigid medium 308, after the media has traveled under the image-forming mechanism 124. Thus, the rigid medium 104, after it travels under the image-forming mechanism 124, will continue to be moved by the conveyor belt 106, until it drops into the collecting mechanism 310.

As before, the rollers 108, 110, and 112 move the conveyor belt 106 in the direction indicated by the arrow 116. The roller 108, where it is the drive roller, may be the drive roller of an inkjet printer that was originally built for flexible media such as paper, where the image-forming mechanism 124 is that of an inkjet printer. Also as before, the guiding of the belt 106 away from the image-forming mechanism 124 in the vicinity of the image-forming substance-absorbing mechanism 114 provides for full-bleed image formation on the rigid medium 104. The image-forming substance mechanism 114 assists in providing such full-bleed image formation, absorbing any substance overage that may otherwise contaminate the conveyor belt 106.

Furthermore, where the image-forming device 300 is intended for the image formation on rigid media that are optical discs, the image-forming device 300 preferably provides for trayless image formation on the optical discs. That is, preferably the image-forming device 300 does not include a tray on which to receive an optical disc for image formation thereon. Rather, the conveyor belt 106, assisted by the rollers 108, 110, and 112 and optionally by the pull-down mechanism 202 of FIG. 2, preferably provides for complete top-contactless movement of the optical disc under the image-forming mechanism 124. This can enable the image-forming device 300 to achieve higher throughput as compared to image-forming devices that employ trays for movement of optical discs.

Figure 5:
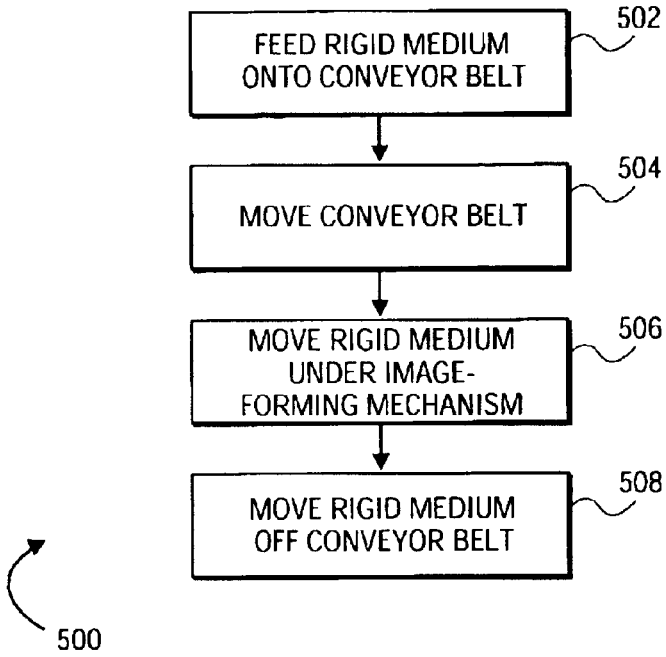
FIG. 5 is a flowchart of a method of use, according to an embodiment of the invention.

FIG. 5 shows a method of use 500, according to an embodiment of the invention. The method 500 may be utilized in conjunction with any of the image-forming mechanisms of FIGS. 1 and 2 and/or the image-forming device of FIGS. 3 and 4. First, a rigid medium is fed from a supply of rigid media onto a conveyor belt (502). The conveyor belt is then moved (504), such as by utilizing rollers. The rigid medium is moved, resulting from movement of the conveyor belt, under an image-forming mechanism (506), for image formation on the rigid medium. The conveyor belt is moved away from the rigid medium as the rigid medium travels under the image-forming mechanism. The rigid medium may be moved between the image-forming mechanism and an image-forming substance-absorbing mechanism, where the conveyor belt moves under the substance-absorbing mechanism during such movement of the rigid medium. Finally, the rigid medium moves off the conveyor belt (508), resulting again from movement of the conveyor belt where the medium can be collected.

Figure 6:
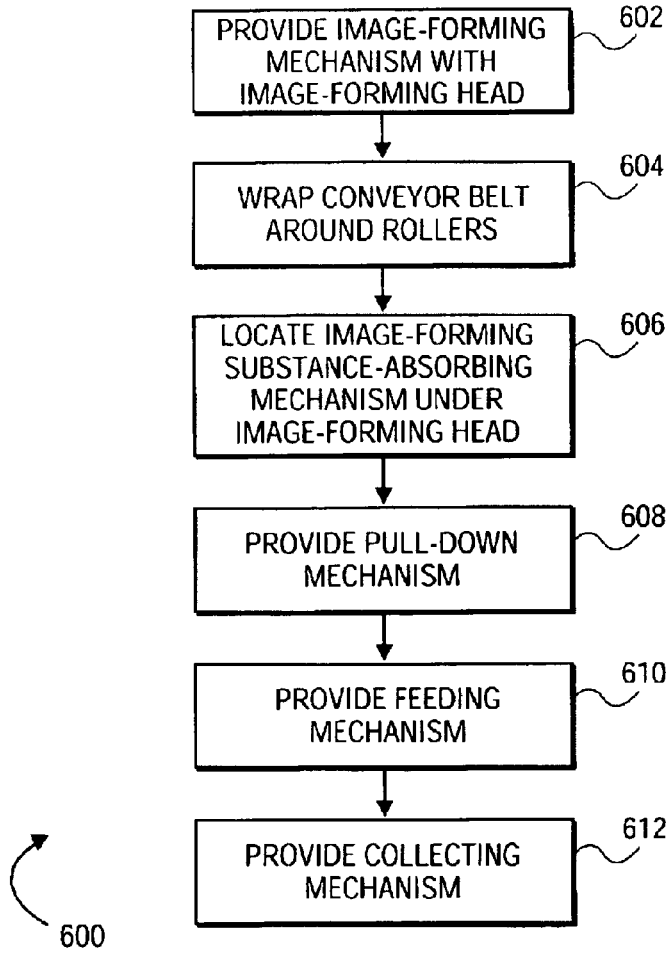
FIG. 6 is a flowchart of a method of manufacture, according to an embodiment of the invention.

FIG. 6 shows a method of manufacture 600, according to an embodiment of the invention. The method 600 may be utilized to manufacture the image-forming device of FIGS. 3 and 4. An image-forming mechanism is provided that includes an image-forming head (602). A conveyor belt is wrapped around a number of rollers, such that the rollers guide the belt away from the image-forming head (604). An image-forming substance-absorbing mechanism can be located under the image-forming head (606), away from which the rollers also guide the conveyor belt. A pull-down mechanism can be provided before and/or after the substance-absorbing mechanism (608). Finally, a feeding mechanism from which to individually feed rigid media onto the conveyor belt for image formation thereon by the image-forming head can be provided (610), as well as a collecting mechanism to collect the rigid media from the conveyor belt after they have had images formed thereon by the image-forming head (612).

It is noted that, although specific embodiments have been illustrated and described herein, it will be appreciated by those of ordinary skill in the art that any arrangement is calculated to achieve the same purpose may be substituted for the specific embodiments shown. Whereas some embodiments of the invention have been described in relation to rigid media that are optical discs, and that include inkjet-printing mechanisms, the invention itself is not limited to such rigid media or such image-forming mechanisms. For instance, the image-forming mechanisms may be laser-printing mechanisms, or other types of mechanisms. Furthermore, whereas embodiments of the invention have been described as including three rollers, there may be more or less rollers in other embodiments of the invention. This application is thus intended to cover any adaptations or variations of the present invention. Therefore, it is manifestly intended that this invention be limited only by the claims and equivalents thereof.

I claim:

1. A mechanism for passing a rigid medium under an image-forming mechanism comprising:

a conveyor belt adapted to support the rigid medium, as the rigid medium travels under the image-forming mechanism for image formation on the rigid medium, such that the rigid medium remains unbent; and, a plurality of rollers to move the conveyor belt, such that a portion of the conveyor belt that is located upstream of the image-forming mechanism is moved away from the rigid medium before the rigid medium passes directly under the image-forming mechanism.

2. The mechanism of claim 1, further comprising an image-forming substance-absorbing mechanism under the image-forming mechanism, the rigid medium passing between the image-forming mechanism and the substance-absorbing mechanism.

3. The mechanism of claim 2, wherein the image-forming substance-absorbing mechanism comprises an absorbent foam pad.

4. The mechanism of claim 2, further comprising a pull-down mechanism located at least one of before and after the substance-absorbing mechanism to maintain positioning of the rigid medium while passing under the image-forming mechanism.

5. The mechanism of claim 4, wherein the pull-down mechanism increases friction between the rigid medium and the conveyor belt.

6. The mechanism of claim 4, wherein the pull-down mechanism comprises at least one of a vacuum and suction mechanism.

7. The mechanism of claim 4, wherein the pull-down mechanism comprises a statically charged mechanism.

8. The mechanism of claim 2, wherein the plurality of rollers are positioned so as to guide the conveyor belt away from the substance-absorbing mechanism.

9. The mechanism of claim 2, wherein the substance-absorbing mechanism and the plurality of rollers are positioned relative to the conveyor belt so as to permit full-bleed image formation by the image-forming mechanism onto the rigid medium while at least substantially preventing substance contamination of the conveyor belt.

10. The mechanism of claim 1, wherein the conveyor belt acts as a bottom contact for travel of the rigid medium under the image-forming mechanism, the mechanism being top contactless.

11. The mechanism of claim 1, wherein the plurality of rollers comprises a tension roller to provide tension to the conveyor belt.

12. The mechanism of claim 1, wherein the plurality of rollers comprises a follower roller positioned such that the rigid medium travels past the follower roller after traveling under the image-forming mechanism.

13. The mechanism of claim 1, wherein the plurality of rollers comprises a drive roller that is rotated to provide force to move the conveyor belt.

14. The mechanism of claim 1, wherein the rigid medium comprises an optical disc, the mechanism providing for trayless image formation on the optical disc.

15. A mechanism for passing a rigid medium under an image-forming mechanism comprising:

a conveyor belt on which the rigid medium travels without top contact in a single direction under the image-forming mechanism for image formation on the rigid medium;

an image-forming substance-absorbing mechanism under the image-forming mechanism, the rigid medium passing between the image-forming mechanism and the substance-absorbing mechanism; and, a plurality of rollers to move the conveyor belt and positioned so as to guide the conveyor belt away from the rigid medium before the rigid medium passes directly under the image-forming mechanism and to permit full-bleed image formation by the image-forming mechanism onto the rigid medium while at least substantially preventing substance contamination of the conveyor belt.

16. The mechanism of claim 15, further comprising a pull-down mechanism located at least one of before and after the substance-absorbing mechanism to maintain positioning of the rigid medium while passing under the image-forming mechanism.

17. The mechanism of claim 15, wherein the plurality of rollers comprises:

a tension roller to provide tension to the conveyor belt;

a follower roller positioned such that the rigid medium travels past the follower roller after traveling under the image-forming mechanism; and, a drive roller that is rotated to provide force to move the conveyor belt.

18. The mechanism of claim 15, wherein the rigid medium comprises an optical disc, the mechanism providing for trayless image formation on the optical disc.

19. A method comprising:

moving a trayless conveyor belt on which a rigid medium has been placed; and, moving the rigid medium under an image-forming mechanism, resulting from moving the conveyor belt, a portion of the conveyor belt that is located upstream of the image-forming mechanism moving away from the rigid medium before the rigid medium travels under the image-forming mechanism.

20. The method of claim 19, wherein moving the rigid medium under the image-forming mechanism comprises moving the rigid medium between the image-forming mechanism and an image-forming substance-absorbing mechanism, the conveyor belt moving under the substance-absorbing mechanism as the rigid medium travels between the image-forming mechanism and the substance-absorbing mechanism.

21. The method of claim 19, further initially comprising feeding the rigid medium from a supply of rigid media onto the conveyor belt.

22. The method of claim 19, further comprising moving the rigid medium off the conveyor belt, resulting from moving the conveyor belt.

23. An image-forming device comprising:

an image-forming mechanism, including an imager forming head;

a conveyor belt adapted to support the rigid medium as the rigid medium travels under the image-forming mechanism for image formation on the rigid medium, such that the rigid medium remains unbent during the entire time in which the rigid medium is moved within the image-forming device; and, a plurality of rollers to move the conveyor belt, such that a portion of the conveyor belt that is located upstream of the image-forming mechanism is moved away from the rigid medium before the rigid medium passes directly under the image-forming mechanism.

24. The image-forming device of claim 23, further comprising a feeding mechanism from which to feed the rigid medium of a plurality of rigid media onto the conveyor belt.

25. The image-forming device of claim 23, further comprising a collecting mechanism to collect the rigid medium after the image formation on the rigid medium has occurred.

26. The image-forming device of claim 23, further comprising an image-forming substance-absorbing mechanism under the image-forming head of the image-forming mechanism, the rigid medium passing between the image-forming mechanism and the substance-absorbing mechanism.

27. The image-forming device of claim 26, further comprising a pull-down mechanism located at least one of before and after the substance-absorbing mechanism to maintain positioning of the rigid medium while passing under the image-forming head.

28. The image-forming device of claim 26, wherein the plurality of rollers are positioned so as to guide the conveyor belt away from the substance-absorbing mechanism and to permit full-bleed image formation by the image-forming head of the image-forming device onto the rigid medium while at least substantially preventing substance contamination of the conveyor belt.

29. The image-forming device of claim 23, wherein the rigid medium is top contactless, and the conveyor belt serves as a bottom contact for the rigid medium.

30. The image-forming device of claim 23, wherein the image-forming mechanism comprises a drive roller that is one of the plurality of rollers.

31. The image-forming device of claim 23, wherein the plurality of rollers comprises a drive roller, a tension roller, and a follower roller.

32. The image-forming device of claim 23, wherein the image-forming mechanism comprises an out-of-media sensor to detect that no additional rigid medium follows the rigid medium under the image-forming head.

33. The image-forming device of claim 32, wherein the out-of-media sensor is further to detect a top of form of the rigid medium and mis-feeding of the rigid medium.

34. The image-forming device of claim 23, wherein the image-forming mechanism is an inkjet-printing mechanism, the image-forming device being an inkjet printhead.

35. The image-forming device of claim 23, wherein the image-forming mechanism is a laser-printing mechanism.

36. The image-forming device of claim 23, wherein the rigid medium comprises an optical disc, the device providing for trayless image formation on the optical disc.

37. An image-forming device comprising:

an image-forming mechanism, including an image-forming head;

means for moving a rigid medium under the image forming head of the image-forming mechanism for image formation on the rigid medium, such that the rigid medium remains unbent during the entire time in which the rigid medium is moved within the image-forming device; and a plurality of rollers to move the conveyor belt, such that a portion of the conveyor belt that is located upstream of the image-forming mechanism is moved away from the rigid medium before the rigid medium passes directly under the image-forming mechanism.

38. The image-forming device of claim 37, wherein the means is for moving the rigid medium under the image-forming head such that the image formation on the rigid medium is full-bleed image formation.

39. The image-forming device of claim 37, wherein the means is for top-contactless moving the rigid medium under the image-forming head.

40. The image-forming device of claim 37, wherein the means comprises:

a conveyor belt on which the rigid medium travels under the image-forming head; and, a plurality of rollers to move the conveyor belt.

41. The image-forming device of claim 40, wherein the means further comprises an image-forming substance-absorbing mechanism under the image-forming head of the image-forming mechanism, the rigid medium passing between the image-forming mechanism and the substance-absorbing mechanism.

42. The image-forming device of claim 41, wherein the means further comprises a pull-down mechanism located at least one of before and after the substance-absorbing mechanism to maintain positioning of the rigid medium while passing under the image-forming head.

43. The image-forming device of claim 37, wherein the rigid medium comprises an optical disc, the device providing for trayless image formation on the optical disc.

44. A method comprising:

providing an image-forming mechanism having an image-forming head; and, wrapping a conveyor belt that is adapted to support a rigid medium, as the rigid medium travels under the image-forming mechanism, around a plurality of rollers, such that the plurality of rollers guides a portion of the conveyor belt that is located upstream of the image-forming mechanism away from the rigid medium before the rigid medium passes under the image-forming head.

45. The method of claim 44, further comprising locating an image-forming substance-absorbing mechanism under the image-forming head, away from which the plurality of rollers guides the conveyor belt.

46. The method of claim 45, further comprising providing a pull-down mechanism located at least one of before and after the substance-absorbing mechanism.

47. The method of claim 44, further comprising providing a feeding mechanism from which to individually feed a plurality of rigid media onto the conveyor belt for image formation thereon by the image-forming head.

48. The method of claim 44, further comprising providing a collecting mechanism to collect rigid media after image formation thereon by the image-forming head.

* * * * *

UNITED STATES PATENT AND TRADEMARK OFFICE

CERTIFICATE OF CORRECTION

PATENT NO. : 6,939,001 B2
DATED : September 6, 2005
INVENTOR(S) : Marius Buibas

It is certified that error appears in the above-identified patent and that said Letters Patent is hereby corrected as shown below:

Title page,
Item [73], Assignee, change "Hewlett-Packard Development Company, L.P., Houston, TX (US)" to -- Microboards Technology LLC, Chanhassen, MN (US) --.

Signed and Sealed this

Fifteenth Day of November, 2005

JON W. DUDAS
*Director of the United States Patent and Trademark Office*